US007722277B2

(12) United States Patent
Byun

(10) Patent No.: US 7,722,277 B2
(45) Date of Patent: May 25, 2010

(54) COSMETICS CASE

(76) Inventor: Young-Kwang Byun, 928-1005, Mok-dong Apt, 312, Shinjeong-dong, Yangcheon-ku, Seoul 158-769 (KR)

( * ) Notice: Subject to any disclaimer, the term of this patent is extended or adjusted under 35 U.S.C. 154(b) by 733 days.

(21) Appl. No.: 11/600,787

(22) Filed: Nov. 17, 2006

(65) Prior Publication Data

US 2008/0107476 A1 May 8, 2008

(30) Foreign Application Priority Data

Sep. 28, 2006 (KR) ..... 10-2006-0094530

(51) Int. Cl.
*A47L 13/22* (2006.01)

(52) U.S. Cl. ..... 401/280; 401/202; 401/205; 401/269; 401/272; 401/286

(58) Field of Classification Search ..... 401/202, 401/205, 269, 270, 272, 280, 281, 286
See application file for complete search history.

(56) References Cited

U.S. PATENT DOCUMENTS 5,678,941 A * 10/1997 Nakajima ..... 401/205
7,377,711 B2 * 5/2008 Byun ..... 401/269
7,416,360 B2 * 8/2008 Tajima ..... 401/280
7,419,323 B1 * 9/2008 Zhang ..... 401/269
7,488,133 B2 * 2/2009 Kuo ..... 401/281

* cited by examiner

*Primary Examiner*—David J Walczak
(74) *Attorney, Agent, or Firm*—Birch, Stewart, Kolasch & Birch, LLP

(57) ABSTRACT

A tube type liquid cosmetics case has a tube shaped case having an opening located at an upper portion, the opening being surrounded by a plurality of moving insert grooves; an upper body coupled to the tube shaped case adjacent the opening; a solution transfer tube; a brush surrounding the solution transfer tube; an insert part provided at a lower portion of the upper body; an eject hole member having a divided opening and a sealing jaw ring located within the insert part; and a plurality of moving insert pieces provided at the lower portion of the upper body and engaging with the plurality of moving insert grooves. A check valve is located in an insert hole provided in the tube shaped case, and a cap is threadably coupled to the upper body.

2 Claims, 6 Drawing Sheets

COSMETICS CASE

CROSS-REFERENCE TO RELATED APPLICATIONS

This application claims the benefit of Korean Patent Application No. 10-2006-0094530, filed on Sep. 28, 2006, in the Korean Intellectual Property Office, the disclosure of which is incorporated herein by reference.

BACKGROUND OF THE INVENTION

1. Field of the Invention

This present invention relates to a cosmetics case, and more particularly, to a tube type liquid cosmetics case including a threaded type combination of the cap protruded from the tube type case to store the liquid cosmetics, the output opening is elevated, and thus the inner ring is occluded to protect leakage of the liquid cosmetics. When the body of the case is compressed, the output opening is lowered and the inner ring is opened and the liquid cosmetics is dispensed. By installing a check valve on the part of the opening hole, it controls input and output of air into the tube type case, to enhance desirable action of repeated serial compression of the tube type case, so that the necessary amount of liquid cosmetics is dispensed or stopped by the consumers need, and it has an effect to protect loss of liquid cosmetics.

2. Discussion of Related Art

Conventionally, the tube vessel storing liquid cosmetics contains a spring or it is necessary to compress the tube vessel to output the liquid cosmetics, and it contains an extra output route and inside of it, it has a screw bar with a ball in the spring, then it is combined with the body of the vessel.

The conventional cosmetics case contains many components, and has a complicated structure and is costly to produce. During use, it needs several to tens of times of rotations of the body holding the upper part of it. Also, there is no additional air input opening to permit air to be infused into the tube vessel, so once the tube vessel is compressed, it is not able to recover to the original state, thus it has a fault to use it for cosmetics by customers.

SUMMARY OF THE INVENTION

This invention is to eradicate the faults of the conventional cosmetics case. The output is elevated by a threaded combination of the cap formed on the superior part of the tube vessel, then the inner ring is occluded to prevent leakage of the liquid cosmetics, while compressing a superior part of its body, the output is lowered and the inner ring is opened, to control the input output of air into the tube vessel by the check valve installed in a part of the opening, so that the repeated serial action of compression of it is enhanced desirably.

BRIEF DESCRIPTION OF THE DRAWINGS

These and/or other objects and advantages of the invention will become apparent and more readily appreciated from the following description of preferred embodiments, taken in conjunction with the accompanying drawings of which.

DETAILED DESCRIPTION OF PREFERRED EMBODIMENTS

Figure 1:
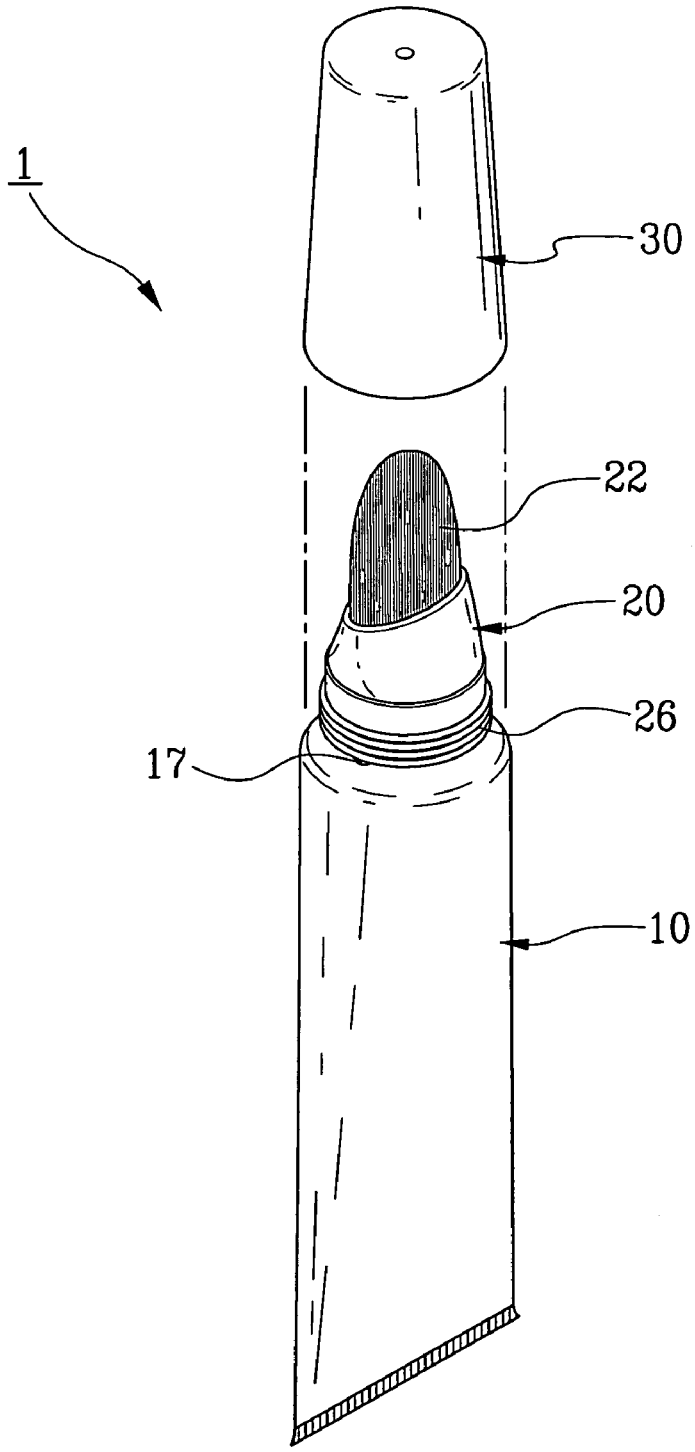
FIG. 1 is a perspective illustration of a cosmetics case with opened cover according to the present invention.

Hereinafter, preferred embodiments of the present invention will be described with reference to the accompanying drawings. Referring now to FIGS. 1-4, a tube type liquid cosmetics case 1 includes an opening 12 formed on the upper part of the tube type case 10, an upper body 20 having a brush 22, coupled on the opening 12 and double coupled with a cap 30, in which an inner single jaw ring 13 is formed on the inside upper part of the case 10, the opening 12 formed with a plurality of moving insert grooves 15 on the periphery thereof, the tube type case 10 including a check valve 17 formed at an insert hole 16 on a side, a solution transfer tube 23 is coupled on an upper part of the tube type case 10 and a brush 22 is insert coupled in the solution transfer tube 23, an insert part 24 and a plurality of moving insert pieces 25 are formed on lower part of inside center of the solution transfer tube 23. External thread parts 26 are formed on an outside lower peripheral part. An eject hole 27 formed with a divide hole 28 and a sealing jaw ring 29 is inserted in the inserting part 24 which formed on the lower part of the solution transfer tube 23, and the upper body 20 is insert coupled on an inside of the opening 12. A cap 30 which formed with an internal threaded part 36 is threaded couple on the upper body 20.

According to the present invention, the ejecting hole 27 is elevated and close seal the inner single jaw ring 13 thus, the ejecting of liquid cosmetics can be stopped by the threaded coupling of the cap 30 which is formed on the upper part of the tube type case 10 storing liquid cosmetics, the eject hole 27 is lowered with pressing of upper body 20 and the inner single jaw ring 13 is opened and the liquid cosmetics is dispensed.

By installing the check valve 17 on the part of the opening 12, it controls input and output of air into the tube type case 10, to enhance a desirable action of repeated serial compression of the tube type case 10, so that the necessary amount of liquid cosmetics is dispensed or stopped by the consumers need, and it has an effect to protect loss of liquid cosmetics.

Figure 2:
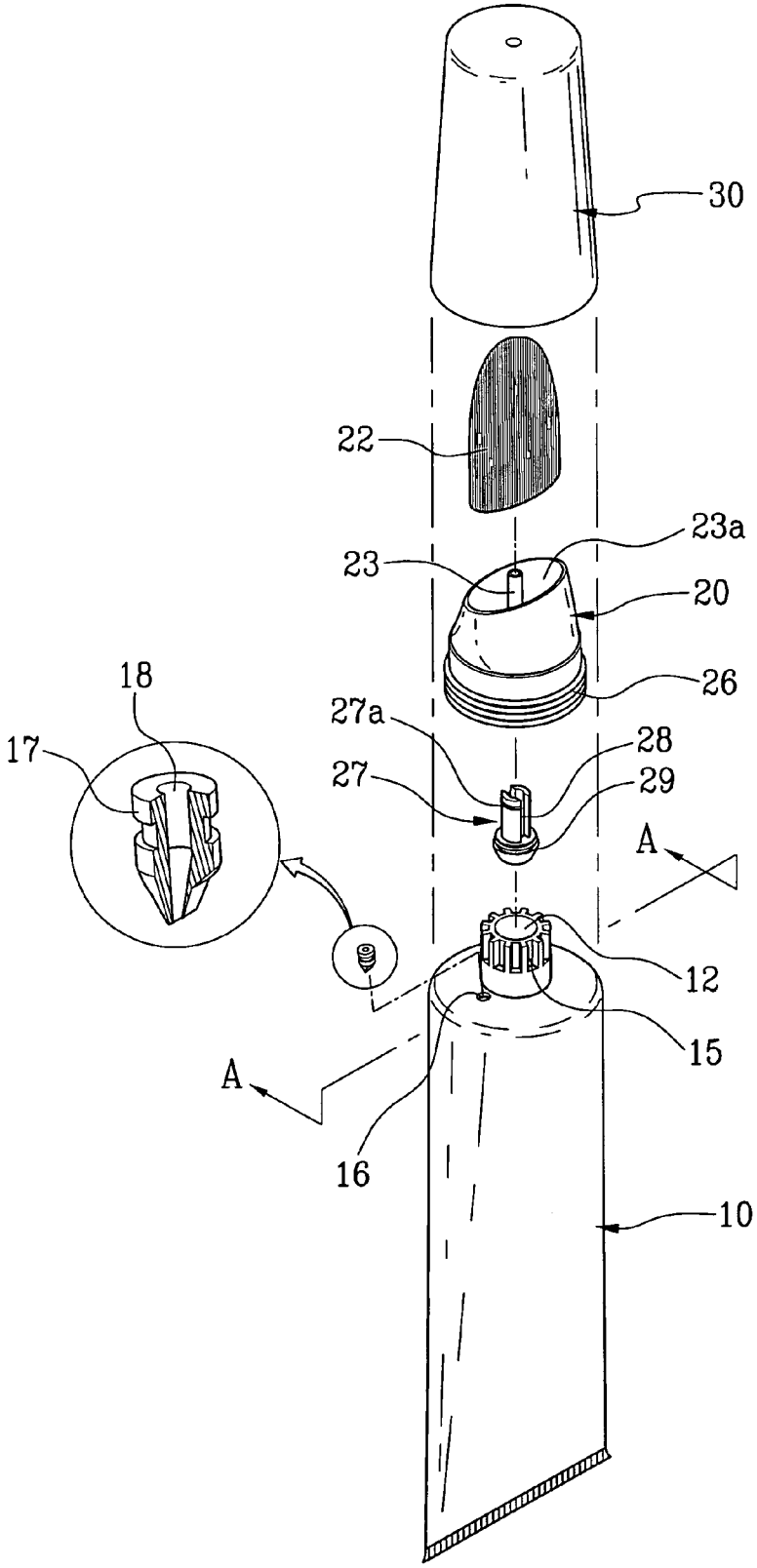
FIG. 2 is an exploded perspective illustration of the cosmetics case according to the present invention.
Figure 3:
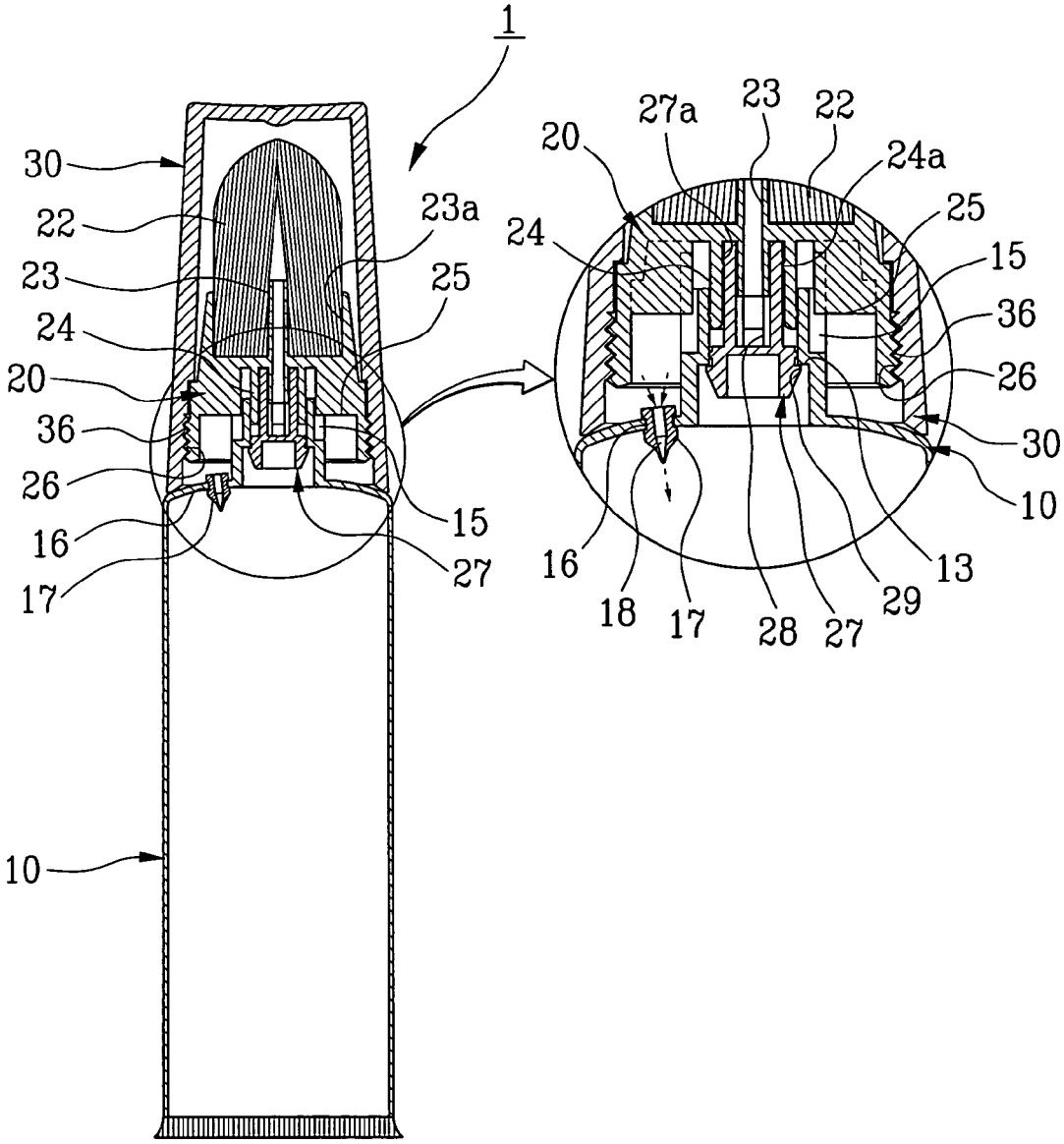
FIG. 3 is a sectional illustration of A-A line coupling of the cosmetics case according to the present invention.
Figure 4:
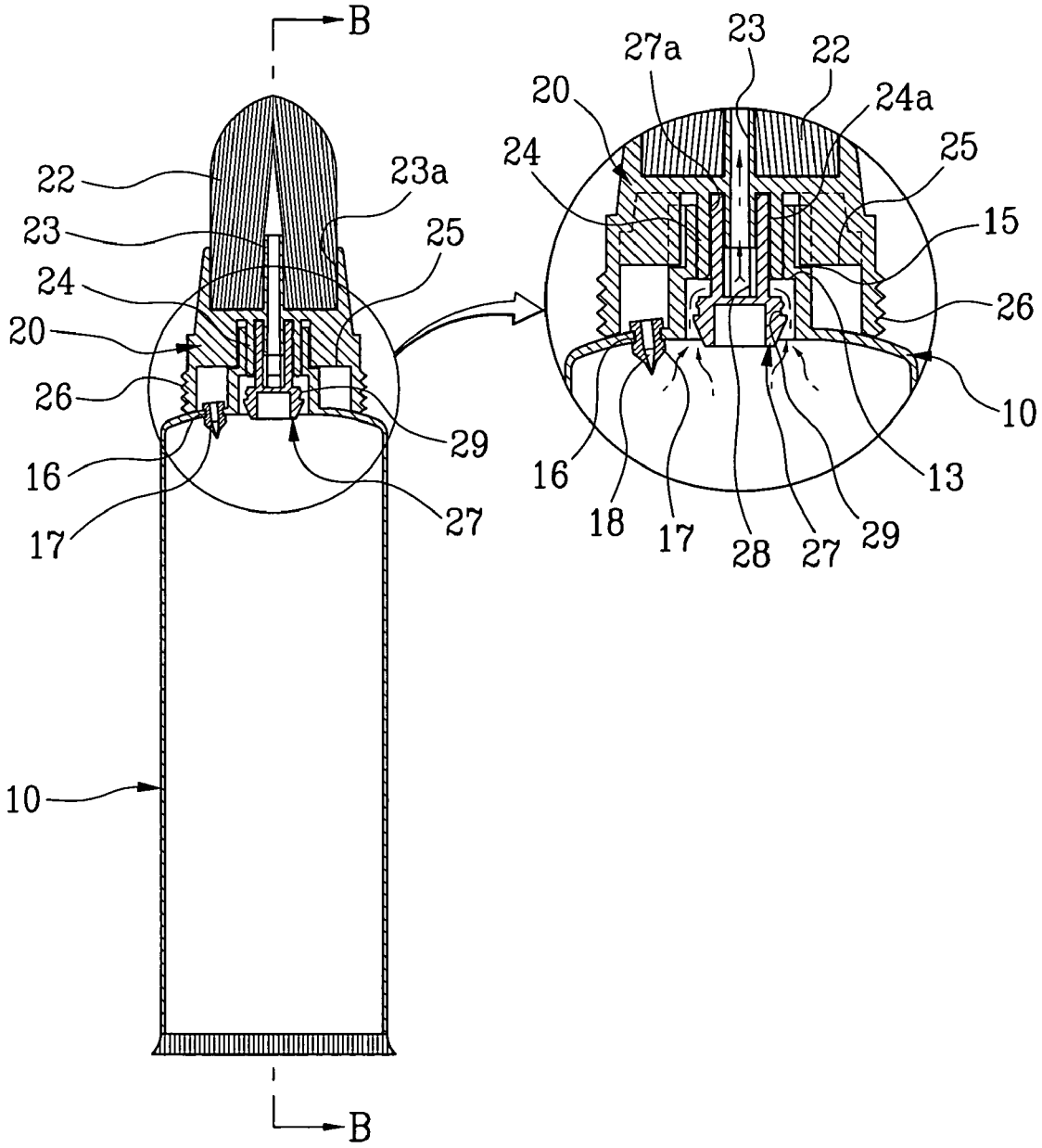
FIG. 4 is a sectional illustration a state in operating of the cosmetics case according to the present invention.

Referring to the drawings, a more detailed description of the operating, action and effects according to the present invention is described. Referring to FIG. 2 to FIG. 4, the opening 12 is provided on the tube type case 10, a check valve 17 is installed in the inserting hole 16 which is formed on a side. The inner single jaw ring 13 is formed in the opening 12, and a plurality of moving insert grooves 15 are formed vertically on the outside of the periphery of the opening 12.

The upper body 20 is coupled on the upper part of the tube type case 10. The solution transfer tube 23 is formed on the center upper part of the upper body 20. The brush insert part 23*a* which is coupled with the brush 22 is formed on the upper body 20. The insert part 24 is formed protruding on the lower center part of the brush insert part 23*a*. The plurality of the moving insert pieces 25 which corresponding to the moving insert grooves 15, are insertably coupled with each other and formed on the periphery along with the center of the insert part 24. An external threaded part 26 is provided on the periphery of the outside lower end forming the upper body 20.

The upper body 20 is insert coupled with the insert part 24 formed on the upper body 20 to the inside of opening 12 formed on the tube type case 10, each of the moving insert pieces 25 which formed to the lower part of the upper body 20 is coupled to insert corresponding with each of the moving insert groove 15 formed along the outside peripherals of the opening 12.

The moving insert grooves 15 and the moving insert pieces 25 which are insertably coupled as above, also by the threaded coupling of the cap 30 described late, the upper body 20 cannot turn, and while, the internal thread part 36 is turning by the turns of the cap 30, relatively the external thread part 26 of the upper body 20 is turning to be elevated.

The eject hole 27 formed a divided opening 28 and sealing jaw ring 29 in inside of the insert part 24 which insert coupled to the inside of the opening 12 thus, the upper body 20 is coupled on the upper part of the tube type case 10 with not able to release by the force joint of the internal protrude ring 24*a* and external protrude ring 27*a*.

Thus, the cap 30 is double coupled on the upper part of the upper body 20 and the external thread part 26 which formed on lower peripheral of the upper body 20 and the internal thread part 36 of the cap 30 are thread coupling and then the tube type liquid cosmetics case 1 according to the present invention is assembled. Therefore, the tube type liquid cosmetics case 1 according to the present invention is maintained the closed cap 30 state in portable.

With the cap 30 in a closed state, the cap 30 is open to be released and the upper body 20 is compressed to the side of the tube case 10 to use for cosmetics, as shown in FIG. 4, the eject hole 27 is move to lowered, the internal jaw ring 13 is opened then, the divided hole 28 is communicated with the solution transfer tube 23.

Figure 5:
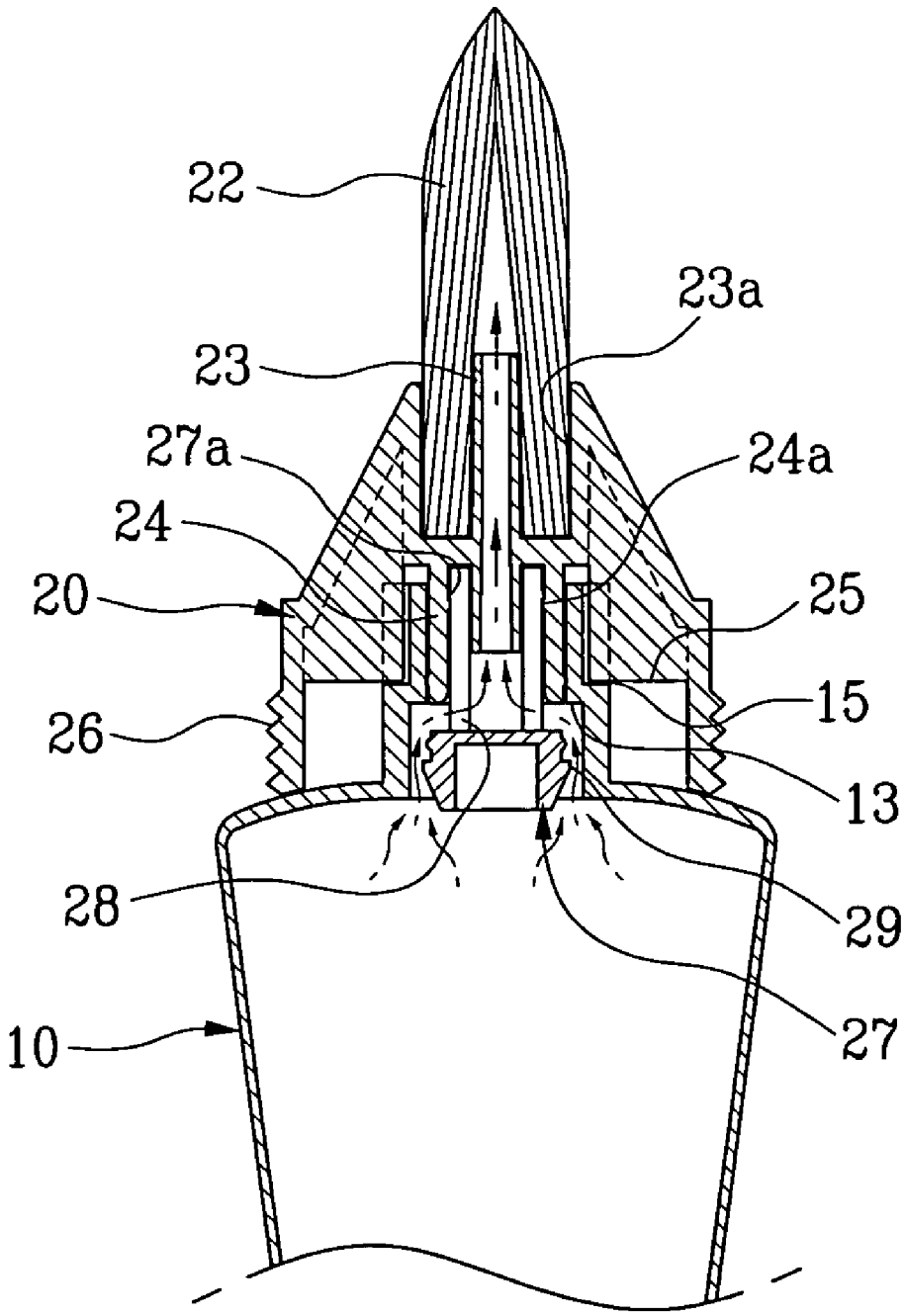
FIG. 5 is a sectional illustration of B-B line coupling enlarged illustration of important part of the cosmetics case according to the present invention.

Thus, the tube case 10 is pressed in the state, as shown in FIG. 4 and FIG. 5, the liquid cosmetics included in the tube case 10 is dispensed through the divided hole 28 and the solution transfer tube 23 to the brush 22. The check valve 17 formed on a side of the opening 12 is formed with a broader upper end and a narrower lower end, and the lower end close engaged.

The check valve 17 is mounted on the insert hole 16, and close the air hole 18 by close shut the lower end engaged with and close shut the air flow. Also, when released the compressed power on the tube type case 10, the tube type case 10 is reciprocated to the original state, the pressure inside of the tube type case 10 is lowered and lower end of the air hole 18 is opened then, out side air is inflow to inside of the tube case 10 via the air hole 18 to easy restitution of the tube case 10.

Figure 6:
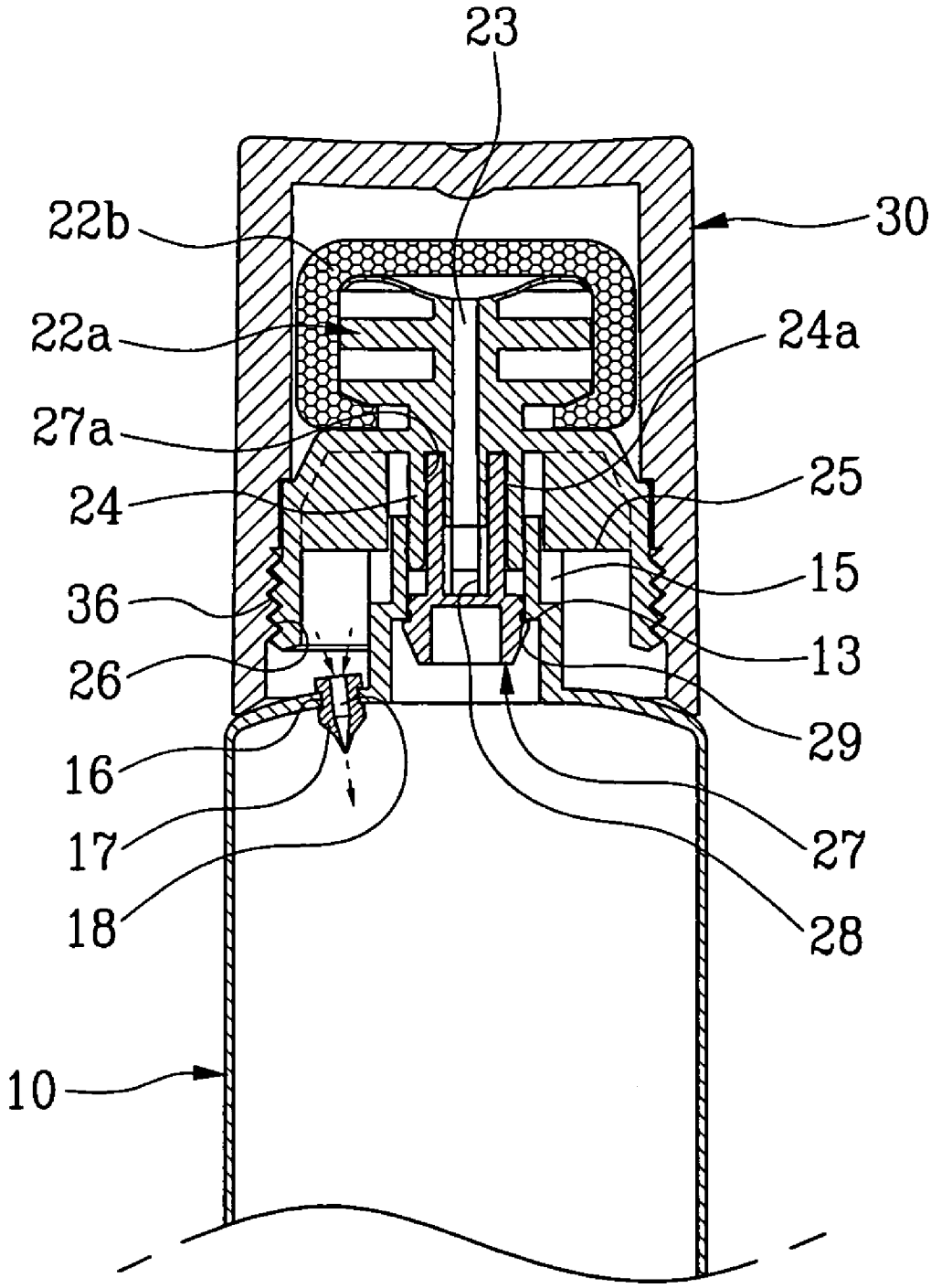
FIG. 6 is an exploded sectional illustration of the cosmetics case according to another preferred embodiment of the present invention.

Therefore, the check valve 17 is able to permit easy reciprocating compressive action of the tube type case 10 by the control of air inflow and outflow with opening and shutting of the air hole 18. Thus, with the reciprocating compressing of the tube case 10, the cosmetics liquid is discharged to the brush 22. Then after the cosmetic use, the cap 30 is covered on the upper part of the upper body 20 and the cap 30 is turned to close by the threaded coupling of the external thread part 26 and the internal thread part 36 with external thread part 26 by the internal thread part 36 relatively, and the upper body 20 is elevated along with the eject hole 27, the sealing ring 29 is close engaged with the inside ring 13 then close shut the cosmetics liquid discharge. FIG. 6 is an exploded sectional illustration of the cosmetics case according to another preferred embodiment of the present invention.

Referring to FIG. 6, a cap holder 22*a* is formed on a periphery of the cosmetics liquid transfer tube 23 which is formed on the central upper part of the upper body 20, and a sponge type cap 22*b* is covered. Thus, the cap 30 is opened to use and the tube type case 10 is reciprocating continually compress, then, the cosmetics liquid is discharged to the sponge type cap 22*b* thus, the consumer use the cosmetic with the sponge type cap 22*b*.

What is claimed is:

1. A cosmetics case comprising:

a tube shaped case having an opening located at an upper portion thereof, an inner single jaw ring formed on the inside of the opening, the opening being surrounded by a plurality of moving insert grooves located around an outer periphery of the opening;

an upper body coupled to the tube shaped case adjacent the opening, the upper body including:

a solution transfer tube;

a brush surrounding the solution transfer tube;

an insert part provided at a lower portion of the upper body;

an eject hole member having a divided opening and a sealing jaw ring located within the insert part;

a plurality of moving insert pieces provided at the lower portion of the upper body and engaging with the plurality of moving insert grooves; and an external threaded part located on an outer periphery of the upper body;

a check valve located in an insert hole provided in the tube shaped case; and a cap having an internal threaded part threadably coupled to the external threaded part of the upper body.

2. The cosmetics case as set forth in claim 1, wherein the check valve includes a broader upper end and a narrower lower end.

* * * * *